US012455094B2

(12) United States Patent
Yang et al.

(10) Patent No.: US 12,455,094 B2
(45) Date of Patent: Oct. 28, 2025

(54) INTELLIGENT CONTROL SYSTEM AND METHOD FOR COOLING DEVICE FOR MANNEQUIN COSTUMES

(71) Applicants: Zhejiang Hengxi Optoelectronics Technology Co., Ltd, Taizhou (CN); Xi'an University of Architecture and Technology, Xi'an (CN)

(72) Inventors: Bin Yang, Xi'an (CN); Ruiqi Guo, Xi'an (CN); Tong Wu, Xi'an (CN); Zhijin Qu, Xi'an (CN); ChenYan Zhang, Xi'an (CN); Xinze Li, Xi'an (CN)

(73) Assignees: Zhejiang Hengxi Optoelectronics Technology Co., Ltd., Taizhou (CN); Xi'an University of Architecture and Technology, Xi'an (CN)

( * ) Notice: Subject to any disclaimer, the term of this patent is extended or adjusted under 35 U.S.C. 154(b) by 74 days.

(21) Appl. No.: 18/498,040

(22) Filed: Oct. 31, 2023

(65) Prior Publication Data

US 2024/0138497 A1 May 2, 2024

(30) Foreign Application Priority Data

Oct. 31, 2022 (CN) ..... 202211342469.4

(51) Int. Cl.
*F24F 13/08* (2006.01)

(52) U.S. Cl.
CPC ..... *F24F 13/08* (2013.01)

(58) Field of Classification Search
CPC .... F24F 13/08; F24F 2110/10; F24F 2110/20; F24F 2120/20; F24F 2221/38
See application file for complete search history.

(56) References Cited

U.S. PATENT DOCUMENTS

2016/0327290 A1* 11/2016 Clemente ..... A41D 13/0056
2018/0317572 A1* 11/2018 Guttman ..... A41D 27/28
2023/0383973 A1* 11/2023 Richelsoph ..... G01K 1/026
2024/0099934 A1* 3/2024 Stanfield ..... A41D 13/12

* cited by examiner

*Primary Examiner* — Marc E Norman
(74) *Attorney, Agent, or Firm* — Hemisphere Law, PLLC; Zhigang Ma

(57) ABSTRACT

The present invention discloses an intelligent control system and method for a doll clothing cooling device, the system including an information acquisition system, an image acquisition system, a computer vision system, and a central control system. The information acquisition system acquires environmental parameters and human physiological parameters in the mannequin garment. The image acquisition system acquires a video image of a human face and transmits it to the computer vision system to calculate a human head temperature. The central control system predicts the human thermal sensation data based on the acquired environmental and physiological parameters. The opening degree of the cooling device of the mannequin garment is automatically adjusted according to the human body heat sensation data and the voice instructions of the wearer of the mannequin garment. The invention solves the problem of dynamically improving the thermal comfort of the wearer of the mannequin costume in real time.

10 Claims, 3 Drawing Sheets

INTELLIGENT CONTROL SYSTEM AND METHOD FOR COOLING DEVICE FOR MANNEQUIN COSTUMES

BACKGROUND OF THE INVENTION

1. Field of the Invention

The present invention belongs to the field of cooling device intelligent control technology, specifically to an intelligent control system and method for cooling devices for mannequin clothing.

2. Description of Related Art

In festivals, performance events, commercial promotions and other activities, cartoon or other images of wearable mannequin costumes have become very popular. Mannequin costume wearers in performance must wear bulky and low breathability clothing. But this wearable mannequin costumes in the use of the process due to poor internal air flow, thus leading to the mannequin costumes in the performers in a hot environment, resulting in a large number of performers sweating, easy to fatigue, prone to symptoms of the Department.

There are many examples of personal safety issues that have occurred due to heat stress of personnel caused by the poor thermal and humid environment inside the mannequin costume. To solve this problem, the most common method of cooling the mannequin costume wearer is now to install a small fan (ventilation/exhaust fan) at the eye and mouth holes of the mannequin costume's head. Firstly, the fan provides a reasonable amount of fresh air for the wearer to breathe. In addition, the fan circulates the air within the head, thus accelerating the evaporation of sweat from the wearer's face. The ventilation fan can also be mounted on top of the sturdy mascot head so that the microclimate air flow within the mascot head is enhanced. However, fan ventilation loses its cooling capacity in humid environments, where the ambient evaporative cooling capacity is significantly limited. In addition, fan cooling has a very limited effect on reducing the temperature of the body centre.

There are still many shortcomings and deficiencies in the current cooling devices for mannequin costumes: 1. Mannequin costume wearer need to manually adjust: mannequin costume wearer need to manually adjust the cooling device, but the actual work in the actor, the actor is generally in accordance with the feeling before the performance to set the cooling device gear, but the actor is always in the activity, the actor's movement state may change at any time, and because the actor in the performance process in order to pursue the immersion. The actors often do not additional adjustment work in the performance. This results in the cooling device not being able to meet the needs of the wearer of the mannequin costume. 2. The system does not have a feedback mechanism: the current doll cooling device is only manually opened by the doll costume wearer, and does not take into account the real thermal feeling and thermal comfort of the doll costume wearer, which may lead to open the cooling device but cannot achieve the expected cooling effect, cannot truly improve the thermal comfort of the doll costume wearer. 3. Cooling device effect is not so well: doll clothing within the cooling position is mostly set in the doll clothing head, which the position is relatively single, resulting in the actual effect of the cooling device is not considerable.

SUMMARY OF THE INVENTION

In order to solve the problems that existing in the prior art, the present invention provides an intelligent control system and method for cooling device of mannequin clothing, which solves the problem that the prior art cannot improve the thermal comfort of the wearer of mannequin clothing in real time.

To achieve that purpose, the present invention provides the following technical solution: an intelligent control system for a mannequin clothing cooling device, including an information acquisition system, an image acquisition system, a computer vision system and a central control system.

The information acquisition system behind is used to obtain the air temperature and humidity in the mannequin costume, the temperature of the head, chest and wrist of the mannequin costume wearer, the gender data of the mannequin costume wearer, the mannequin costume wearer's BMI data and the voice commands of the mannequin costume wearer.

Image acquisition system for acquiring video images of the face of the wearer of the mannequin costume and transmitting them to the computer vision system.

Computer vision system for obtaining video of the face of the wearer of the mannequin costume to obtain the head temperature of the wearer of the mannequin costume.

The central control system is used to obtain the head, chest and wrist temperature of the wearer according to the information acquisition system and the head temperature of the wearer according to the computer vision system, and obtain the integrated human body temperature according to the integrated human body temperature, the temperature and humidity in the doll costume, the gender data of the wearer and the BMI data of the wearer to get the human body thermal sensation data TSV; and then adjust the opening degree of the cooling device according to the human body thermal sensation data TSV and the voice command of the wearer of the doll costume.

Furthermore, the information collection system includes a sensor module and hand rings, and the sensor module includes an air dry bulb temperature sensor and an air humidity sensor set on the head of the mannequin costume, and two infrared temperature sensors set on the chest of the mannequin costume wearer and the head position of the mannequin costume wearer, respectively; the hand ring includes a wrist temperature measurement module, a personal information collection module and a voice recognition module. The wrist temperature measurement module is used to measure the wrist temperature of the mannequin costume wearer; The personal information collection module is used to collect the gender data of the mannequin costume wearer and the mannequin costume wearer's BMI date; The voice recognition module is used to receive the mannequin costume wearer's voice commands and transmitted to the central control system to achieve the cooling device open degree control.

Furthermore, the image acquisition system is a webcam, and the webcam is set in the head of the mannequin costume for obtaining the mannequin costume wearer face video; the cooling device is adjustable small fan, and the adjustable small fan maximum power is 8 w, which cooling device is set in the mannequin costume back area and mannequin costume feet area.

Furthermore, the computer vision system includes a video splitting module, an image enhancement module and an Euler video magnification module, the video splitting module is used to split the video of the mannequin costume wearer's face into low-light images, the image enhancement module is used to optimize the low-light images into normal-light video information using the EnlightenGAN low-light image enhancement algorithm, and the Euler video magnification module uses the Euler video magnification algorithm to obtain the head temperature of the mannequin costume wearer.

Furthermore, the central control system includes an integrated temperature determination module, a thermal sensation anthropomorphism module, an openness calculation module and a feedback module, the integrated temperature determination module is used to calculate the integrated human body temperature $T_{zonghe}$ based on the human wrist, chest and head temperatures acquired by the information acquisition system and the head temperature acquired by the computer vision system:

$$T_{zonghe}=a*T_{wan}+b*T_{tou1}+C*T_{tou2}+d*T_{xiong}+t$$

$T_{zonghe}$ is the comprehensive temperature linear function of the mannequin costume wearer; a is the weight of the mannequin costume wearer's wrist temperature; b is the weight of the mannequin costume wearer's head temperature measured by the infrared temperature sensor; c is the weight of the mannequin costume wearer's head temperature calculated by Euler video amplification technology; d is the weight of the mannequin costume wearer's chest temperature; t is the correction value; $T_{wan}$ is the human wrist temperature, $T_{xiong}$ is the human chest temperature, $T_{tou1}$ is the human head temperature obtained by the information acquisition system, $T_{tou2}$ is the head temperature obtained by the computer vision system;

The thermal sensation anthropomorphic module for the human body based on the integrated temperature, information acquisition system to obtain the air temperature and humidity in the mannequin clothing, the gender data of the mannequin costume wearer and the BMI data of the mannequin costume wearer to calculate the human thermal sensation data TSV;

Opening degree calculation module for obtaining the opening degree data of the cooling device based on the human thermal sensation data TSV;

The feedback module is used to obtain the voice command of the wearer of the mannequin costume and control the opening degree of the cooling device according to the opening degree data of the cooling device and the voice command.

Further, the human thermal sensation data TSV is calculated specifically as:

When the wearer of the mannequin costume is male, and BMI less than 18.5:

$$TSV=e1*T_{zonghe}+f1*RH_{in}+J1*T_{air}+constant$$

When BMI more than or equal to 18.5, but less than 24:

$$TSV=e2*T_{zonghe}+f2*RH_{in}+J2*T_{air}+constant$$

When BMI greater than or equal to 24:

$$TSV=e3*T_{zonghe}+f3*RH_{in}+J3*T_{air}+constant$$

When the mannequin costume wearer is female, and BMI less than 18.5:

$$TSV=e4*T_{zonghe}+f4*RH_{in}+J4*T_{air}+constant$$

When BMI more than or equal to 18.5, but less than 24:

$$TSV=e5*T_{zonghe}+f5*RH_{in}+J5*T_{air}+constant$$

When BMI greater than or equal to 24

$$TSV=e6*T_{zonghe}+f6*RH_{in}+J6*T_{air}+constant$$

TSV is a linear function of the thermal sensation data of the wearer of the mannequin costume;

e1, e2, e3, e4, e5 and e6 are the combined temperature weights for different BMI ranges for different genders of the mannequin costume wearers, respectively;

f1, f2, f3, f4, f5 and f6 are the relative humidity weights of the mannequin costume wearers for different genders and different BMI ranges, respectively;

J1, J2, J3, J4, J5 and J6 are the air dry bulb temperature weights of the mannequin costume wearers for different genders and different BMI ranges, respectively;

constantis the intercept distance.

Furthermore, opening degree data of the cooling device is obtained according to the heat sensation data specifically as follows:

when the human body heat sensation data is less than or equal to 1, the opening degree of the cooling device is in 0 gear;

when the human body thermal sensation data is greater than 1 and less than 1.5, the opening degree of the cooling device is in 1 gear;

When the human thermal sensation data is greater than or equal to 1.5 and less than 2, the opening of the cooling device is in 2 gears;

When the human thermal sensation data is greater than or equal to 2 and less than 2.5, the opening of the cooling device is in 3 gears;

When the human body thermal sensation data is greater than 2.5, the opening of the cooling device is in 4 gears.

Furthermore, the voice instructions of the doll clothing wearer include increasing one gear, lowering one gear, turning off the device and turning on the equipment, and when the feedback module receives the command to increase one gear, the opening of the cooling device is adjusted by one gear; When the feedback module receives the command to reduce by one gear, the opening of the adjustment cooling device is reduced by one gear; When the feedback module receives the instruction to turn off the device, the information collection system gives feedback on whether to confirm the shutdown of the device, if the reply Yes the feedback module adjusts the opening of the cooling device to zero gear, if the reply No the feedback module does not adjust the gear of the cooling device; When the feedback module receives the command to open the device, the information collection system gives feedback on whether to confirm the opening of the cooling device, if the reply is Yes, the feedback module adjusts the cooling device gear to one gear, if the reply is No, the cooling device continues to turn off.

Furthermore, further comprising a data storage system, the data storage system includes a data receiving module, a data storage module, a data upload module and a data transmission module, the data receiving module for receiving data transmitted by the information acquisition system, the image acquisition system, the computer vision system and the central control system, the data storage module for storing the data transmitted by the data receiving module; the data upload module for uploading the data in the data storage module to the cloud network disk once every 1 hour; the data transmission module for selectively transmitting the data to the information acquisition system, the image acquisition system, the computer vision system and the central control system.

The present invention also provides a mannequin costume cooling device intelligent control method, the specific steps are as follows:

S1 acquiring the gender data, the BMI data and voice commands of the mannequin garment wearer;

S2 obtaining the wrist, chest and human head temperature of the mannequin costume wearer measured by the temperature sensor and the head temperature of the mannequin costume wearer obtained through video information, to obtain the integrated human body temperature $T_{zonghe}$;

S3 to obtain the air temperature and humidity data in the doll costume, according to the human body integrated temperature, air temperature and humidity data, the gender data the BMI data of the person wearing the doll costume to obtain the human body thermal sensation data TSV;

S4 according to the human body thermal sensation data to determine the cooling device open gear, according to the voice command to adjust the cooling device open gear.

Compared with the prior art, the present invention has at least the following beneficial effects:

The present invention provides a mannequin clothing cooling device intelligent control system, through the information acquisition system real-time detection of air temperature and humidity in the mannequin clothing, mannequin clothing wearer's head, chest and wrist temperature, mannequin clothing wearer's gender data, mannequin clothing wearer's BMI data, through the image acquisition system to obtain the mannequin clothing wearer's face video image, through the computer vision system again calculate to get the mannequin Costume wearer's head temperature, the central control system according to the information acquisition system, computer vision system to obtain data to calculate the comprehensive temperature of the human body, and according to the comprehensive temperature of the human body, the temperature and humidity in the mannequin clothing, mannequin clothing wearer's gender data, mannequin clothing wearer's get human thermal sensation data, the central control system according to the mannequin clothing wearer's BMI data to get the human thermal sensation data TSV in order to determine the cooling device opening degree data, not only can Reduce unnecessary energy consumption, but also as far as possible to maximize the wearer's thermal comfort, the invention by calculating the human thermal sensation data TSV to get the cooling device open degree, in order to achieve energy saving, accurate to meet the thermal needs of the wearer's dolls, control the cooling device open degree size to do "people-oriented", the wearer's dolls The purpose of maximizing thermal comfort, reduce or even kill the body damage caused by heat stress of the mannequin clothing wearer.

Furthermore, the invention system also includes voice recognition module, which can be combined with the human body heat sensation data TSV to adjust the cooling device by real-time recognition of the voice of the puppet costume wearer, a high degree of intelligence, which can respond to some unexpected situations and emergency response capability is stronger, and solve the puppet costume wearer in the performance process because the performance requirements cannot always adjust the puppet costume cooling device problem;

2. The system does not have a feedback mechanism: the current doll cooling device is merely manually opened by the Mascot costume wearer, and does not take into account the real thermal feeling and thermal comfort of the mascot costume wearer, which may lead to open the cooling device but the expected cooling effect can not be achieved, Inability to truly improve the thermal comfort of the wearer of the puppet costume.

3. Cooling device effect is not good: doll clothing within the cooling position is mostly set in the doll clothing head, the position is relatively single, resulting in the actual effect of the cooling device is not considerable.

DETAILED DESCRIPTION OF THE PREFERRED EMBODIMENTS

Figure 1:
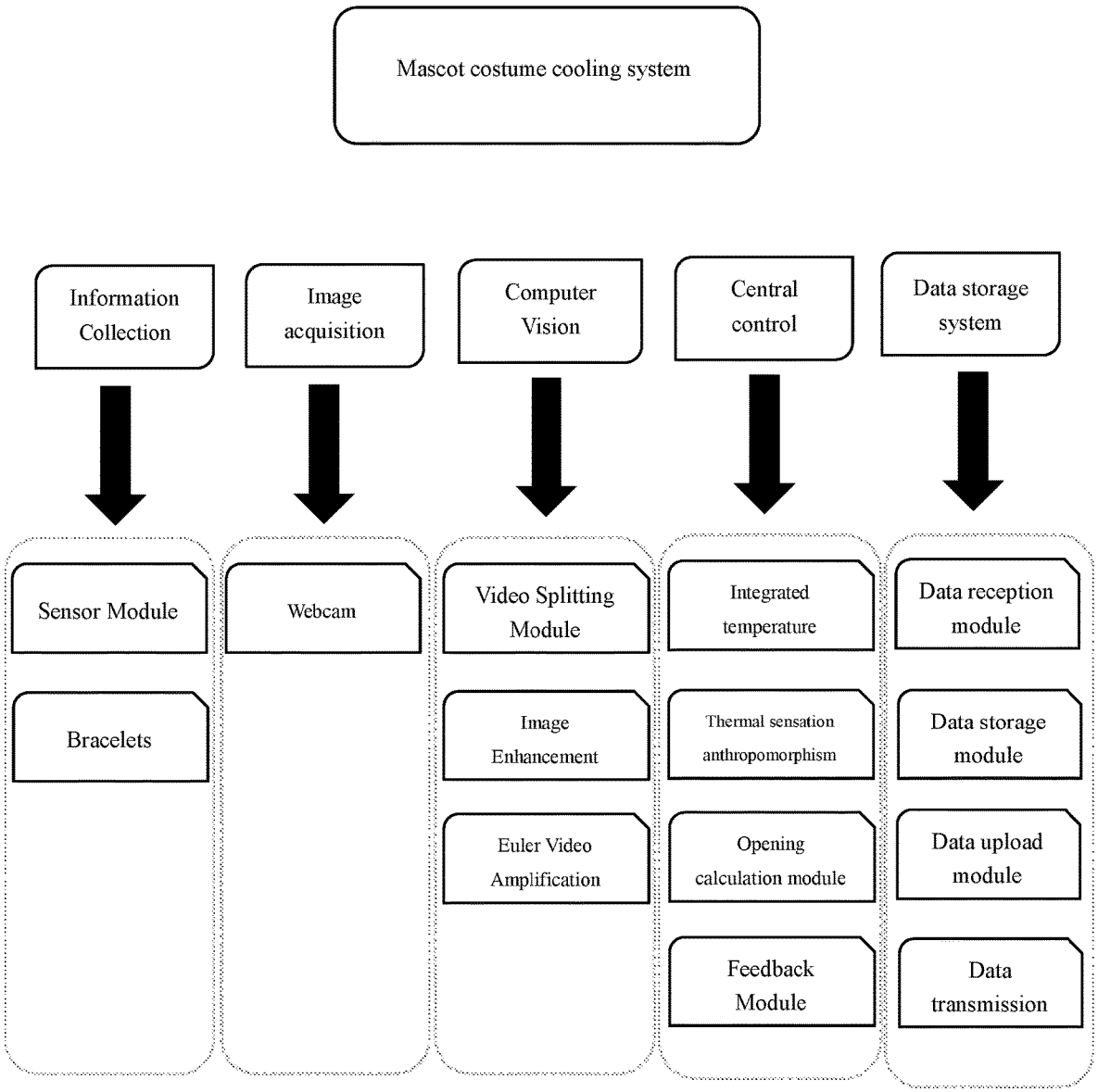
FIG. 1 is the composition diagram of an intelligent control system of an action figure clothing cooling device of the invention.
Figure 2:
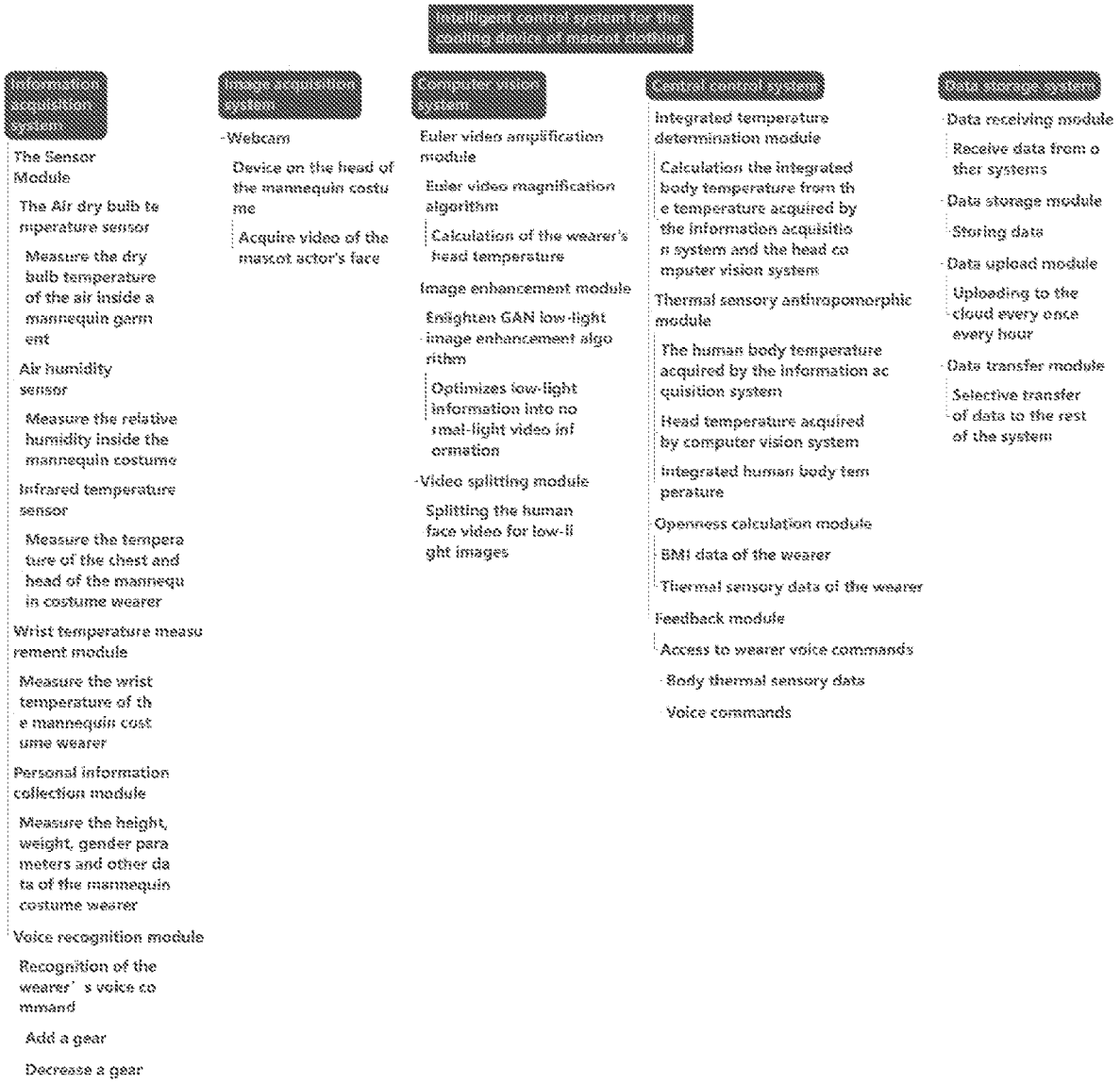
FIG. 2 is the function diagram of an intelligent control system of an action figure clothing cooling device of the invention.
Figure 3:
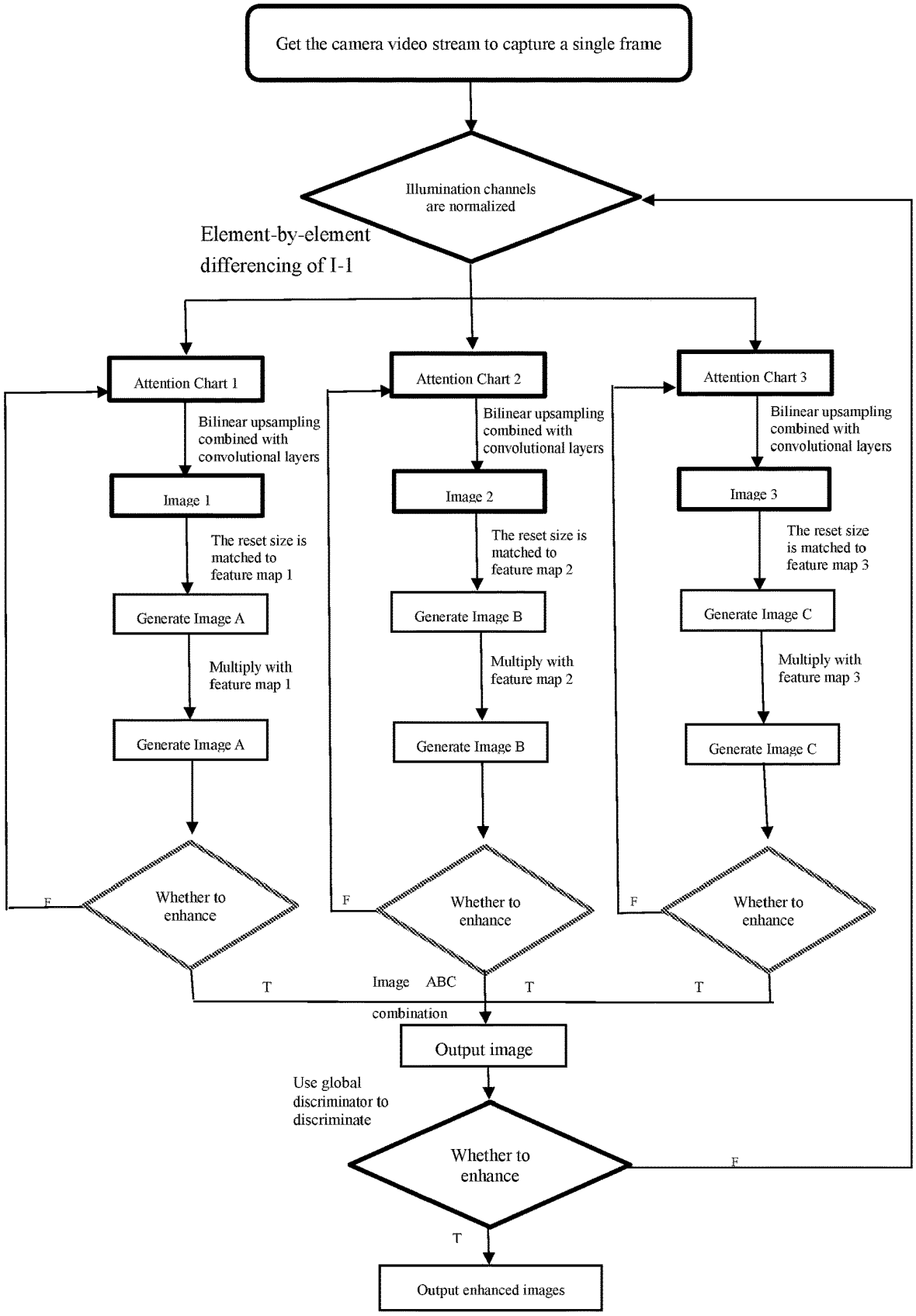
FIG. 3 is the flowchart of the EnlightenGAN algorithm.

The present invention also provides a method of the intelligent control for a puppet clothing cooling device, the specific steps are as follows:

S1 acquiring the gender data, and voice commands of the wearer of the mannequin garment;

S2 obtaining the wrist, chest and the temperature of human head and the mannequin costume wearer measured by the temperature sensor and the head temperature of the mannequin costume wearer obtained through video information to obtain the comprehensive temperature of the human body;

S3 to obtain the air temperature and humidity data in the mannequin costume, according to the comprehensive body temperature, air temperature and humidity data, the gender data of the mannequin costume wearer, to obtain the human body thermal sensation data;

S4 determines the opening gear of the cooling device according to the human body thermal sensation data, and adjust the opening gear of the cooling device according to the voice command.

Compared with the prior art, the present invention has at least the following beneficial effects:

The invention provides a mannequin clothing cooling device intelligent controls system, through the information acquisition system real-time detection of air temperature and humidity in the mannequin clothing, mannequin clothing wearer's head, chest and wrist temperature, mannequin clothing wearer's gender data, mannequin clothing wearer's, through the image acquisition system to obtain the mannequin clothing wearer's face video image, through the computer vision system again calculator to gets the mannequin Costume wearer's head temperature, the central control system according to the information acquisition system, computer vision system to obtain data to calculate the combined temperature of the human body, and according to the comprehensive temperature of the human body, the temperature and humidity in the mannequin clothing, mannequin clothing wearer's gender data, mannequin clothing wearer's get human thermal sensation data, the central control system according to the human thermal sensation data to determine the cooling device opening degree data, not only can reduce unnecessary energy consumption, but also as far as possible to maximize the wearer's thermal comfort, the invention through the calculation of human thermal sensation data to get the cooling unit opening, in order to achieve energy saving, accurate to meet the thermal needs of the wearer's dolls, control the cooling device open degree size to do "people-oriented", the wearer's dolls the purpose of maximizing thermal comfort, reduce or even kill the body damage caused by heat stress of the mannequin clothing wearer.

Further, the invention system also includes voice recognition module, can be combined with the human body heat sensation data to adjust the cooling device by real-time recognition of the voice of the puppet costume wearer, a high degree of intelligence, can respond to some unexpected situations, emergency response capability is stronger. It solves the problem that the mascot costume wearer cannot adjust the puppet costume cooling device at any time due to the requirements of the performance during the performance.

Specifically, the bracelet is worn on the wrist of the mascot costume wearer;

Further, the bracelet may be used to take the temperature of wrist;

S2, obtaining the height $H_{eight}$, weight $W_{eight}$, gender $G_{ender}$ data of the person wearing the mascot costume, and calculating the BMI of the mascot costume wearer.

Specifically, obtaining the height $H_{eight}$ weight $W_{eight}$ and gender $G_{ender}$ data of the mascot costume wearer by the mascot costume wearer entering the height $H_{eight}$, weight $W_{eight}$ and gender $G_{ender}$ data into the bracelet;

Specifically, BMI is calculated as follows:

$$BMI=W_{eight}\div H_{eight}^2$$

S3, obtaining the air dry bulb temperature $T_{air}$, humidity $RH_{in}$ data inside the head of the mascot costume wearer, the wrist temperature $T_{wan}$ of the mascot costume wearer, the chest temperature $T_{xiong}$ of the mascot costume wearer, the head temperature $T_{tou1}$ of the mascot costume wearer.

Specifically, the temperature of the human chest and the human head is measured by the infrared temperature measuring device;

Specifically, the infrared temperature measuring device is set on the chest of the mascot costume wearer;

Specifically, the temperature of human wrist is measured by the bracelet;

Specifically, the bracelet has a built-in body temperature monitoring chip and a high-precision thermistor.

S4, obtaining the video information of the head of the mascot costume wearer to obtain the head temperature $T_{tou2}$ of the mascot costume wearer;

Specifically, the monitoring system captures the low light mp4 format video information of the target face in real time by the camera and transmits them to the computer vision system, which converts the original low light video information into normal light video information through the EnlightenGAN image enhancement algorithm under low light;

Specifically, the camera is set on the head of the mascot costume, facing the face of the mascot costume wearer.

Specifically, the EnlightenGAN low-light image enhancement algorithm is implemented in the following steps:

1) Acquiring the camera video stream and capturing a single frame image;
2) Training the EnlightenGAN network deep learning model by unsupervised method using SCIE dataset;
3) Using the trained EnlightenGAN network to optimize the low-light images and obtain normal-light video information;

Further, processing the input normal light video information by the Eulerian video amplification algorithm module to obtain the head temperature $T_{tou2}$ of the mascot costume wearer;

S5, real-time calculation to obtain the integrated human body temperature $T_{zonghe}$;

Specifically, the integrated human body temperature $T_{zonghe}$ is calculated from the human wrist temperature $T_{wan}$, the human chest temperature $T_{xiong}$, the human head temperature $T_{tou1}$ measured by the infrared temperature sensor and the head temperature $T_{tou2}$ calculated by the Euler video amplification technique, calculated as follows:

$$T_{zonghe}=a*T_{wan}+b*T_{tou1}+C*T_{tou2}d*T_{xiong}+t$$

Where $T_{zonghe}$ is the integrated temperature linear function of the mascot costume wearer;

a is the weight of the wrist temperature of the mascot costume wearer;

b is the weight of the head temperature of the mascot costume wearer measured by the infrared temperature sensor;

c is the weight of the head temperature of the mascot costume wearer calculated by Euler video amplification technique;

d is the weight of the chest temperature of the mascot costume wearer;

t is the correction value.

S6, obtaining the human thermal sensation data and then through the algorithm to calculate the opening data cooling device in real time and control work of the cooling device;

Specifically, the mascot costume wearer is identified as a healthy adult;

Specifically, the thermal sensation data TSV take a value standard according to ASHRAE (American Society of Heating, Refrigeration and Air-Conditioning Engineers American Society of Heating and Air-Conditioning Engineers) developing the specification ASHRAE Standard 55-2020, determined as a 7-point system, the specific division as shown in Table 1:

TABLE 1

Thermal sensation volume table

| Thermal sensation | Cold | Cool | Slightly cool | Neutral | Slightly warm | Warm | Hot |
|---|---|---|---|---|---|---|---|
| Thermal sensation data TSV | −3 | −2 | −1 | 0 | 1 | 2 | 3 |

Specifically, the human thermal sensation data TSV is calculated by the BMI of the mascot clothing weirs, the integrated human body temperature $T_{zonghe}$, the relative air humidity $RH_{in}$, and the air dry bulb temperature data $T_{air}$, which are calculated as follows:

When the gender $G_{ender}$ is male, BMI is less than 18.5, $$TSV=e1*T_{zonghe}+f1*RH_{in}+J1*T_{air}+constant$$

When the gender $G_{ender}$ is male and BMI is greater than or equal to 18.5 and less than 24, $$TSV=e2*T_{zonghe}+f2*RH_{in}+J2*T_{air}+constant$$

When the gender $G_{ender}$ is male and BMI is greater than or equal to 24, $$TSV=e3*T_{zonghe}+f3*RH_{in}+J3*T_{air}+constant$$

When the gender $G_{ender}$ is female and BMI is less than 18.5, $$TSV=e4*T_{zonghe}+f4*RH_{in}+J4*T_{air}+constant$$

When the gender $G_{ender}$ is female and BMI is greater than or equal to 18.5 and less than 24, $$TSV=e5*T_{zonghe}+f5*RH_{in}+J5*T_{air}+constant$$

When the gender $G_{ender}$ is female and BMI is greater than or equal to 24, $$TSV=e6*T_{zonghe}+f6*RH_{in}+J6*T_{air}+constant$$

e1, e2, e3, e4, e5, e6 are the combined temperature weights of the mascot costume wearer in different BMI ranges for different genders, respectively;

f1, f2, 13, f4, f5, f6 are the relative humidity weights of the mascot costume wearer for different BMI ranges by gender, respectively;

J1, J2, J3, J4, 15, J6 are the air dry bulb temperature weights of the mascot costume wearer in different sexes and different BMI ranges, respectively constant is the intercept distance.

Specifically, the cooling device open degree data from the human thermal sensation data TSV is calculate through the open degree algorithm, and then be adjusted through the mascot clothing wearer's voice to. There are five grades in the opening degree;

Specifically, the cooling device is an adjustable small fan;

Specifically, the adjustable small fan rated power is 8 w;

Specifically, the cooling device is set in the back and feet area of the mascot costume;

Specifically, the specific opening algorithm is as follows:

When the human body thermal sensation data TSV is less than or equal to 1, the opening degree of cooling device is in 0 gear, the cooling device does not work, the speed is 0;

When the human body thermal sensation data TSV is greater than 1 and less than 1.5, the opening degree of cooling device is in 1st gear, the cooling device works at low speed, and the speed is about 1800 r/min;

When the human body thermal sensation data TSV is greater than or equal to 1.5 and less than 2, the opening degree of cooling device is in 2nd gear, the cooling device works at medium speed, and the speed is about 2400 r/min;

When the human thermal sensation data TSV is greater than or equal to 2 and less than 2.5, the opening degree of cooling device is in 3rd gear, and the cooling device works at high speed, with a rotational speed of about 3000 r/min;

When the human body thermal sensation data TSV is greater than 2.5, the cooling device is in 4th gear, and the cooling device works at the limit speed, and the rotational speed is about 3600 r/min.

Further, adjusting the opening degree of the cooling device by recognizing the voice of the mascot costume wearer;

Specifically, first setting the control password (for example, set the control password 123456), controlling first enters the voice: "control cord 123456", then the system will feedback "please say your instructions", the specific instructions are "Increase one gear, decrease one gear, turn off the device, open the device.

When the command is "increase one gear", the opening degree of cooling device will be increased by 1 gear; When the command is "decrease one gear", the opening degree of cooling device will be decreased by 1 gear; When the command is "turn off the device", the system will feedback "whether to confirm turning off the device", if the response is "yes", the cooling device will be adjusted to 0 gear, if the response is "no", the cooling device will continue to run in the original gear; When the command is "open equipment", the system will feedback "whether to confirm opening the cooling device", if the response is "yes", the cooling device will be adjusted to the first gear, if the response is "no", the cooling device will be adjusted to the first gear. If "No", the cooling device will continue to close.

What is claimed is:

1. An intelligent control system for a cooling device for a mannequin costume; comprising an information acquisition system, an image acquisition system, a computer vision system and a central control system;

wherein the information acquisition system is used to obtain an air temperature and humidity in the mannequin costume, a first head temperature, a chest temperature, a wrist temperature, gender data, body mass index (BMI) data and voice commands of a wearer of the mannequin costume;

wherein the image acquisition system is used to acquire video images of a face of the wearer of the mannequin costume and transmit the video images to the computer vision system;

wherein the computer vision system is used to obtain a video of the face and a second head temperature of the wearer of the mannequin costume; and wherein the central control system is used to obtain an integrated human body temperature based on the first head temperature, the chest temperature and the wrist temperature of the wearer of the mannequin costume obtained by the information acquisition system and the second head temperature of the wearer of the mannequin costume obtained by the computer vision system; obtain a human body thermal sensation data TSV based on the integrated human body temperature, the air temperature and humidity in the mannequin costume, the gender data and the BMI data of the wearer of the mannequin costume; and obtain opening data of the cooling device according to the human body thermal sensation data TSV and the voice commands of the wearer.

2. The intelligent control system for the cooling device for the mannequin costume according to claim 1, wherein the information acquisition system comprises a sensor module and a hand ring, the sensor module comprises an air dry bulb temperature sensor and an air humidity sensor set in a head of the mannequin costume, and two infrared temperature sensors set in a chest of the wearer of the mannequin costume and a head of the wearer of the mannequin costume respectively; and the hand ring comprises a wrist temperature measurement module, a personal information collection module and a voice recognition module; the wrist temperature measurement module is used to measure the wrist temperature of the wearer of the mannequin costume; the personal information collection module is used to collect the gender data and the BMI data of the wearer of the mannequin costume and the voice recognition module is used to receive the voice commands of the wearer of the mannequin costume and transmit the voice commands to the central control system to control an opening degree of the cooling device.

3. The intelligent control system for the cooling device for the mannequin costume according to claim 1, wherein the image acquisition system is a webcam, and the webcam is set on the head of the mannequin costume to obtain the video of the face of the wearer of the mannequin costume; the cooling device is an adjustable fan, and the adjustable fan has a maximum power of 8 watts (w); and the cooling device is set in a back area of the mannequin costume and a foot area of the mannequin costume.

4. The intelligent control system for the cooling device for the mannequin costume according to claim 1, wherein the computer vision system comprises a video splitting module, an image enhancement module and an Euler video amplification module; the video splitting module is used to split the video of the face of the wearer of the mannequin costume into low light images; the image enhancement module is used to optimize the low light images into normal light video information by using an EnlightenGAN low light image enhancement algorithm, and the Euler video amplification module is used to obtain the second head temperature of the wearer of the mannequin costume by using an Euler video amplification algorithm.

5. The intelligent control system for the cooling device for the mannequin costume according to claim 1, wherein the central control system comprises an integrated temperature determination module, a thermal sensation anthropomorphic module, an openness calculation module and a feedback module;

the integrated temperature determination module is used to calculate the integrated human body temperature $T_{zonghe}$ based on the wrist temperature, the chest temperature and the first head temperature of the wearer obtained by the information acquisition system and the second head temperature obtained by the computer vision system temperature:

$$T_{zonghe}=a*T_{wan}+b*T_{tou1}+C*T_{tou2}+d*T_{xiong}+t$$

where $T_{zonghe}$ is a linear function of the integrated human body temperature of the wearer of the mannequin costume; a is a weight of the wrist temperature of wearer of the mannequin costume; b is a weight of the first head temperature of the wearer of the mannequin costume measured by an infrared temperature sensor; c is a weight of the second head temperature of the wearer of the mannequin costume calculated by an Euler video amplification algorithm; d is a weight of the chest temperature of the wearer of the mannequin costume; t is a correction value; $T_{wan}$ is the wrist temperature of the wearer of the mannequin costume; $T_{xiong}$ is the chest temperature of the wearer of the mannequin costume; $T_{tou1}$ is the first head temperature of the wearer of the mannequin costume obtained by the information acquisition system; and $T_{tou2}$ is the second head temperature obtained by the computer vision system;

the thermal sensation anthropomorphic module is used to obtain the human body thermal sensation data TSV based on the integrated human body temperature, the air temperature and humidity in the mannequin costume, and the gender data and the BMI data of the wearer of the mannequin costume acquired by the information acquisition system the openness calculation module is used to obtain the opening data of the cooling device based on the human body thermal sensation data TSV; and the feedback module is used to obtain the voice commands of the wearer of the mannequin costume and control an opening degree of the cooling device based on the opening data of the cooling device and the voice commands.

6. The intelligent control system for the cooling device for the mannequin costume according to claim 5, wherein the human body thermal sensation data TSV is calculated specifically as follows:

when the wearer of the mannequin costume is a male, and a BMI is less than 18.5:

$$TSV=e1*T_{zonghe}+f1*RH_{in}+1*T_{air}+constant$$

when the BMI is greater than or equal to 18.5 and less than 24:

$$TSV=e2*T_{zonghe}+f2*RH_{in}+J2*T_{air}+constant$$

when the BMI is greater than or equal to 24:

$$TSV=e3*T_{zonghe}+f3*RH_{in}+J3*T_{air}+constant$$

when the wearer of the mannequin costume is a female, and a BMI is less than 18.5:

$$TSV=e4*T_{zonghe}+f4*RH_{in}+J4*T_{air}+constant$$

when the BMI is greater than or equal to 18.5 and less than 24:

$$TSV=e5*T_{zonghe}+f5*RH_{in}+J5*T_{air}+constant$$

when the BMI is greater than or equal to 24:

$$TSV=e6*T_{zonghe}+f6*RH_{in}+J6*T_{air}+constant$$

where e1, e2, e3, e4, e5, e6 are combined temperature weights for the wearer of the mannequin costume for different BMI ranges and different genders, respectively;

f1, f2, f3, f4, f5, f6 are relative humidity weights for the wearer of the mannequin costume for the different genders and the different BMI ranges, respectively;

J1, J2, J3, J4, J5, J6 are air dry bulb temperature weights for the wearer of the mannequin costume for the different genders and the different BMI ranges, respectively; and constant is an intercept distance.

7. The intelligent control system for the cooling device for the mannequin costume according to claim 6, wherein the opening data of the cooling device obtained according to the human body thermal sensation data TSV is specifically as:

when the human body thermal sensation data TSV is less than or equal to 1, the opening degree of the cooling device is in a position 0;

when the human body thermal sensation data TSV is greater than 1 and less than 1.5, the opening degree of the cooling device is in a position 1;

when the human body thermal sensation data TSV is greater than or equal to 1.5 and less than 2, the opening degree of the cooling device is in a position 2;

when the human body thermal sensation data TSV is greater than or equal to 2 and less than 2.5, the opening degree of the cooling device is in a position 3;

when the human body thermal sensation data TSV is greater than 2.5, the opening degree of the cooling device is opened in a position 4.

8. The intelligent control system for the cooling device for the mannequin costume according to claim 1, wherein the voice commands comprise adding one gear, lowering one gear, turning off the cooling device, turning on the cooling device;

when the feedback module receives the voice command of the adding one gear, the opening degree of the cooling device is added by one gear;

when the feedback module receives the voice command of the lowering one gear, the opening degree of the cooling device is lowered by one gear;

when the feedback module receives the voice command of the turning off the cooling device, the information acquisition system feeds back whether to confirm turning off the cooling device, when a reply is yes, the feedback module will adjust the opening degree of the cooling device to 0 gear, when the reply is no, the feedback module will not adjust the cooling device;

when the feedback module receives the voice command of the turning on the cooling device, the information acquisition system feeds back whether to confirm turning on the cooling device, when the reply is yes, the feedback module will adjust the opening degree of the cooling device to 1 gear, when the reply is no, the cooling device remains closed.

9. The intelligent control system for the cooling device for the mannequin costume according to claim 1, further comprising a data storage system;

wherein the data storage system comprises a data receiving module, a data storage module, a data upload module and a data transmission module; the data receiving module is used to receive data transmitted by the information acquisition system, the image acquisition system, the computer vision system and the central control system; the data storage module is used to store the data transmitted by the data receiving module; the data upload module is used to upload the data in the data storage module to a cloud network disk once every one hour; and the data transmission module is used to selectively transmit the data to the information acquisition system; the image acquisition system, the computer vision system and the central control system.

10. A method for an intelligent control system for a cooling device for a mannequin costume, comprising the following steps:

S1, obtaining gender data, BMI data and voice commands of a wearer of the mannequin costume;

S2, obtaining a wrist temperature, a chest temperature and a first head temperature of the wearer of the mannequin costume measured by temperature sensors and a second head temperature of the wearer of the mannequin costume obtained by video information to obtain an integrated human body temperature $T_{zonghe}$;

S3, obtaining an air temperature and humidity data in the mannequin costume, and obtaining a human body thermal sensation data TSV based on the integrated human body temperature, the air temperature and humidity data, and the gender data and the BMI data of the wearer of the mannequin costume; and S4, determining an opening degree of the cooling device according to the human body heat sensation data TSV, and adjusting the opening degree of the cooling device according to the voice commands.

* * * * *